US006962536B2

(12) United States Patent
Hall et al.

(10) Patent No.: US 6,962,536 B2
(45) Date of Patent: Nov. 8, 2005

(54) GOLF ACCESSORY HAVING MULTIPLE FUNCTIONS

(75) Inventors: Jeffrey Hall, Wallingford, CT (US); Paul Hebert, Manchester, CT (US)

(73) Assignee: Tuga, Inc., Mooreston, NJ (US)

( * ) Notice: Subject to any disclaimer, the term of this patent is extended or adjusted under 35 U.S.C. 154(b) by 130 days.

(21) Appl. No.: 10/137,021

(22) Filed: May 1, 2002

(65) Prior Publication Data

US 2003/0207721 A1 Nov. 6, 2003

(51) Int. Cl.[7] ..... A63B 55/10; A63B 47/02; A24F 15/08

(52) U.S. Cl. ..... 473/282; 473/286; 294/19.2; 131/241; 248/156

(58) Field of Search ..... 473/282, 286; 294/19.2; 21/721; 131/241; 211/70.2; 248/156, 248/688

(56) References Cited

U.S. PATENT DOCUMENTS

| | | | | | |
|---|---|---|---|---|---|
| 3,580,260 | A | * | 5/1971 | Moore | 131/242 |
| 4,252,666 | A | * | 2/1981 | Kozawa et al. | 473/288 |
| 4,462,595 | A | * | 7/1984 | Hodson | 473/243 |
| 4,659,125 | A | * | 4/1987 | Chuan | 294/19.2 |
| 5,188,409 | A | * | 2/1993 | Forey | 294/19.2 |
| 5,282,619 | A | * | 2/1994 | Napolitano et al. | 473/239 |
| 5,520,389 | A | * | 5/1996 | Furrow | 473/286 |
| 5,597,363 | A | * | 1/1997 | Leote | 473/282 |
| 5,624,328 | A | * | 4/1997 | Lovich | 473/282 |
| 5,765,647 | A | * | 6/1998 | Hood | 172/371 |
| 5,820,479 | A | * | 10/1998 | Cline et al. | 473/282 |
| D400,612 | S | * | 11/1998 | Rubin | D21/796 |
| 5,873,471 | A | * | 2/1999 | Ruggeri | 211/70.2 |
| 6,234,916 | B1 | * | 5/2001 | Carusillo et al. | 453/5 |
| 6,390,931 | B1 | * | 5/2002 | Berndt | 473/282 |
| 6,497,327 | B1 | * | 12/2002 | Rindfleisch | 211/70.2 |

* cited by examiner

*Primary Examiner*—Stephen Blau
(74) *Attorney, Agent, or Firm*—Milton Wolson

(57) ABSTRACT

A compact golf accessory which may function as a cigar holder, golf club rest or golf ball retriever. The golf accessory is conveniently carried in a golf bag.

10 Claims, 13 Drawing Sheets

GOLF ACCESSORY HAVING MULTIPLE FUNCTIONS

A. BACKGROUND OF THE INVENTION

1. Field of the Invention

The present invention is a light weight, compact golf accessory which functions as a cigar holder, golf club rest, and golf ball retriever. The golf accessory conveniently fits within a golf bag along with the golf clubs.

2. Description of the Prior Art

Cigar holders for use by golfers are known in the prior art. A golfer smoking a cigar while playing a round of golf often does not have a convenient location to place his cigar when he stops to hit a shot. While he may simply place the cigar on the fairway, if the fairway is damp or wet, the cigar may become wet and unsmokable. Also, the green or fairway may contain chemical agents which could be transferred to the cigar and be ingested by the smoker with potentially adverse consequences. The same situation exists for golfers smoking cigarettes.

Further, it is common for a golfer to carry two or more golf clubs while considering which club to use for a particular shot. After selecting the club, the golfer may place the other club or clubs on the ground while the shot is taken. However, if the ground is damp or wet, the club and particularly the handle portion may become wet and dirty. In addition, it is not unknown for clubs that have been left on the ground to become lost. Golf club rests are provided to avoid the problems associated with laying a golf club on the ground.

The prior art includes golf accessories which perform multiple functions. For example, U.S. Pat. No. 5,285,990 issued to Engel discloses a golf accessory which functions as a golf rest and cigar holder. A stake at one end of the golf accessory is insertable into the ground for maintaining the golf accessory in an upright position.

While playing golf, the golfer may inadvertently hit the ball into water or in a position where the ball may not be readily retrieved. Therefore, golf ball retrievers have been provided which enable a golfer to retrieve an otherwise inaccessible golf ball. U.S. Pat. No. 4,733,681 issued to Lee, discloses a golf accessory which functions as both a golf ball retriever, having several telescopically nested tubes, and an umbrella.

B. SUMMARY OF THE INVENTION

The present invention is a light weight, compact golf accessory which functions as a cigar holder, golf club rest, and golf ball retriever. The golf accessory conveniently fits within a golf bag along with the golf clubs. In a preferred embodiment, the golf accessory includes a releasably mounted combined cigar holder and golf club rest head and a releasably mounted golf ball retriever. Hollow rods which comprise the body portion of the golf accessory are compressed when the golf accessory is used as a combined cigar holder and golf club rest and extended when the golf accessory is used as a golf ball retriever. The hollow rods are compressible within a base tube and are extendible therefrom.

Accordingly, it is an object of this invention to provide a light weight, compact golf accessory which functions as a cigar holder, golf club rest, and golf ball retriever;

It is a further object of this invention to provide a light weight, compact golf accessory which includes a releasably mounted cigar holder and golf club rest;

It is a still further object of this invention to provide a light weight, compact golf accessory which includes a releasably mounted golf ball retriever;

It is an additional object of this invention to provide a light weight, compact golf accessory which includes a releasably mounted extendible golf ball retriever head; and It is a still additional object of this invention to provide a light weight, compact golf accessory having a body portion which is compressed when the golf accessory is used as a cigar holder and golf rest and which is extended when the golf accessory is used as a golf ball retriever.

It is another object of this invention to provide a light weight, compact golf accessory having a body portion which includes a stake that is extendible when the golf accessory is mounted in the ground and which is retractable when the golf accessory is to be hand held.

Other objects and attendant advantages of this invention will be readily appreciated as the same becomes more clearly understood by references to the following detailed description when considered in connection with the accompanying drawings in which like reference numerals designate like parts throughout the figures thereof.

C. BRIEF DESCRIPTION OF THE DRAWINGS

For a fuller understanding of the nature and objects of the invention, reference should be had to the following detailed description taken in connection with the accompanying drawing forming a part of this specification and in which similar numerals of reference indicate corresponding parts in all the figures of the drawing.

D. DETAILED DESCRIPTION OF THE PREFERRED EMBODIMENTS

Figure 1:
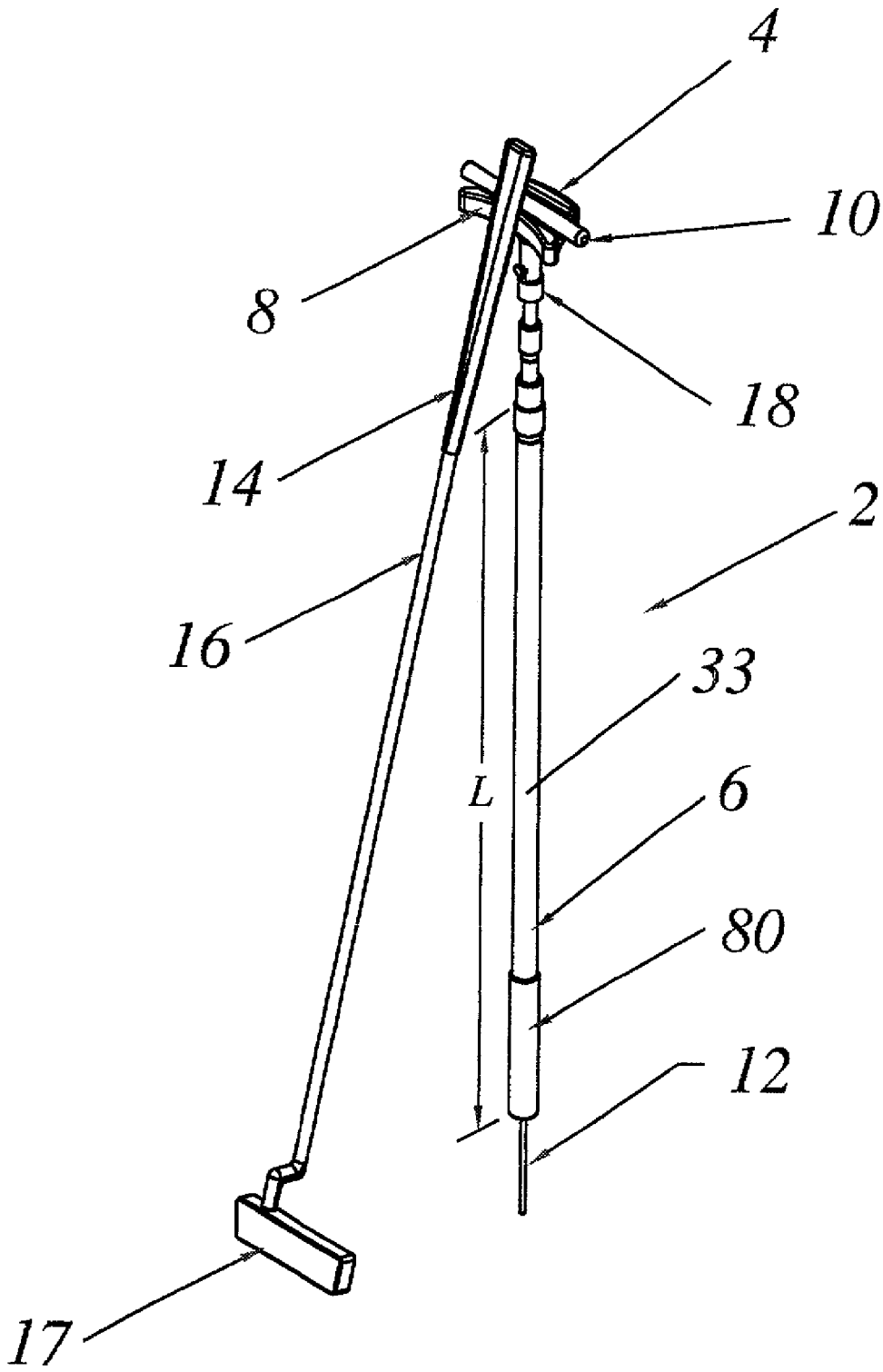
FIG. 1 is a front perspective view of a golf accessory including a releasably mounted combination cigar holder and club rest head.
Figure 2:
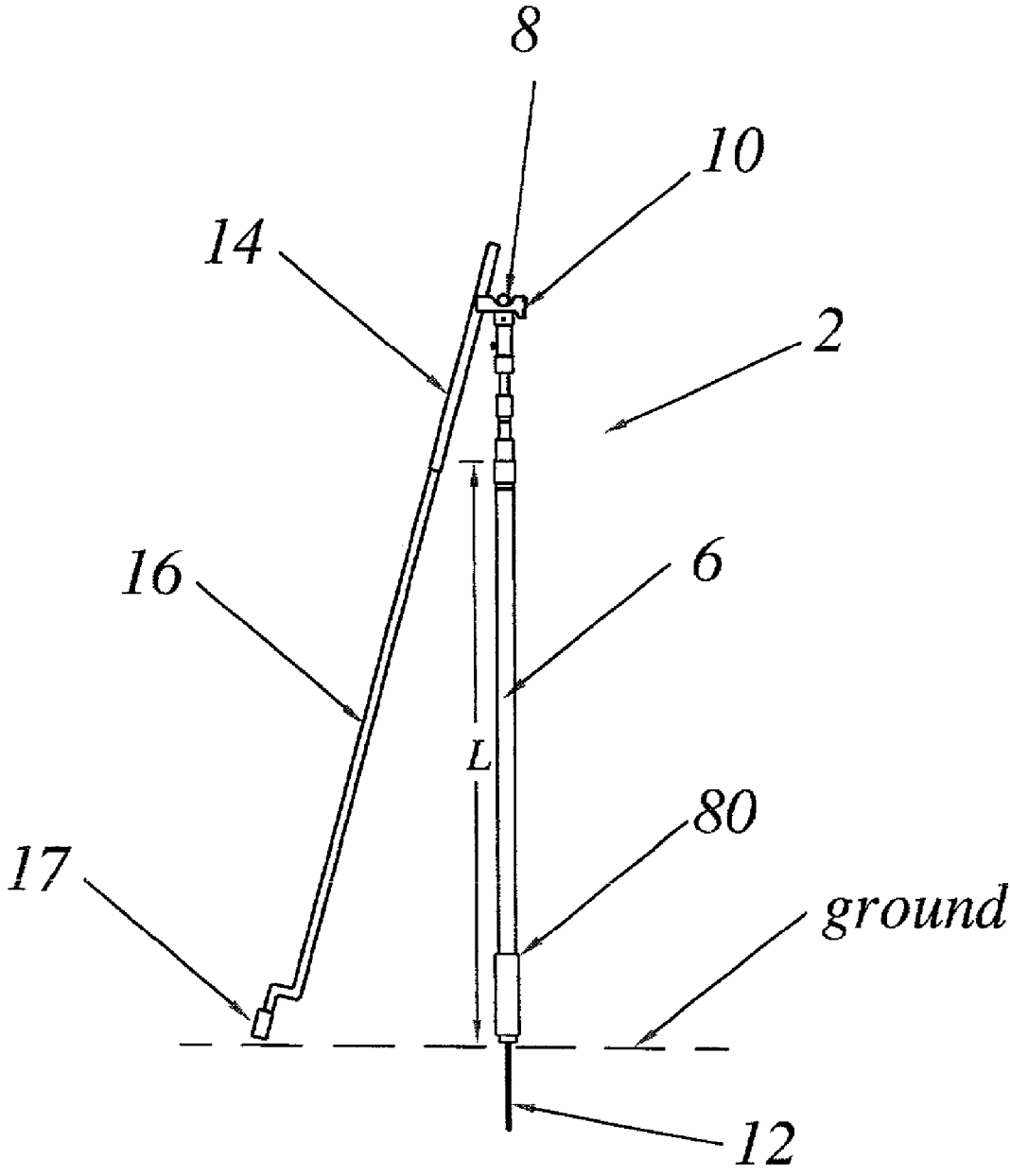
FIG. 2 is a side elevational view of the golf accessory shown in FIG. 1.

In FIGS. 1 and 2, there is shown a first embodiment of a golf accessory 2 comprising a releasably mounted combination cigar holder and golf club rest head 4. The head 4 consists of a cradle 8 which serves as a golf club rest and a cigar holder 10 for holding a cigar. It is within the scope of this invention that cigar holder 10 also functions to hold cigarettes. When the golf accessory 2 functions as a golf club rest and cigar holder, a body portion 6 comprising three linerally extendible concentric hollow rods of different diameters, described further below, are compressed within a base tube to form a body portion of length, L. The hollow rods may be formed of metal or other suitable material. When, alternatively, the golf accessory 2 functions as a golf ball retriever, the three linear concentric hollow rods are extended from the base tube with respect to each other in the manner described below. It is within the present invention that four or more linerally extendible concentric hollow rods may be utilized if a golf ball retriever of greater length is desired.

When the golf accessory 2 functions as a golf club rest and cigar holder, a retractable stake 12 of preferably solid material, extends from the bottom of outer extendible hollow rod 32 into the ground for maintaining golf accessory 2 in a standing position. When golf accessory 2 is so positioned, the handle 14 of a golf club 16, having a club face 17, is supported in an upright position by the interior surface of arcuate shaped cradle 8. In this manner, a golf club not being used during a shot may be supported vertically to avoid the club from becoming damp, wet or lost. The length L is selected so that golf club handle 14, or in some instances the golf club shaft, will lie in cradle 8 and so that golf accessory 2 will fit within a golf bag.

Further, when golf accessory 2 is in its upright position, a cigar 18 may be placed in arcuate shaped cigar holder 10 when the golfer is hitting a shot. The golf club rest and cigar holder may function separately-or they may be used together at the same time. The cradle 8 and cigar holder 10 are formed of flame retardant plastic, or metal or other suitable material, and may be available in a variety of colors. The plastic may be, for example, a 10% glass fiber ABS plastic which is UV stable, heat resistant and flame retardant. Cradle 8 includes a vertical concave surface 24, best seen in FIG. 4, on which the handle 14 or a shaft of the golf club rests. Cigar holder 10 includes a horizontal concave surface 26, best seen in FIG. 3, on which the cigar 18 may rest. Head 4 also includes inset surfaces 23 and 25 for placing decals and a molded logo 27.

Figure 3:
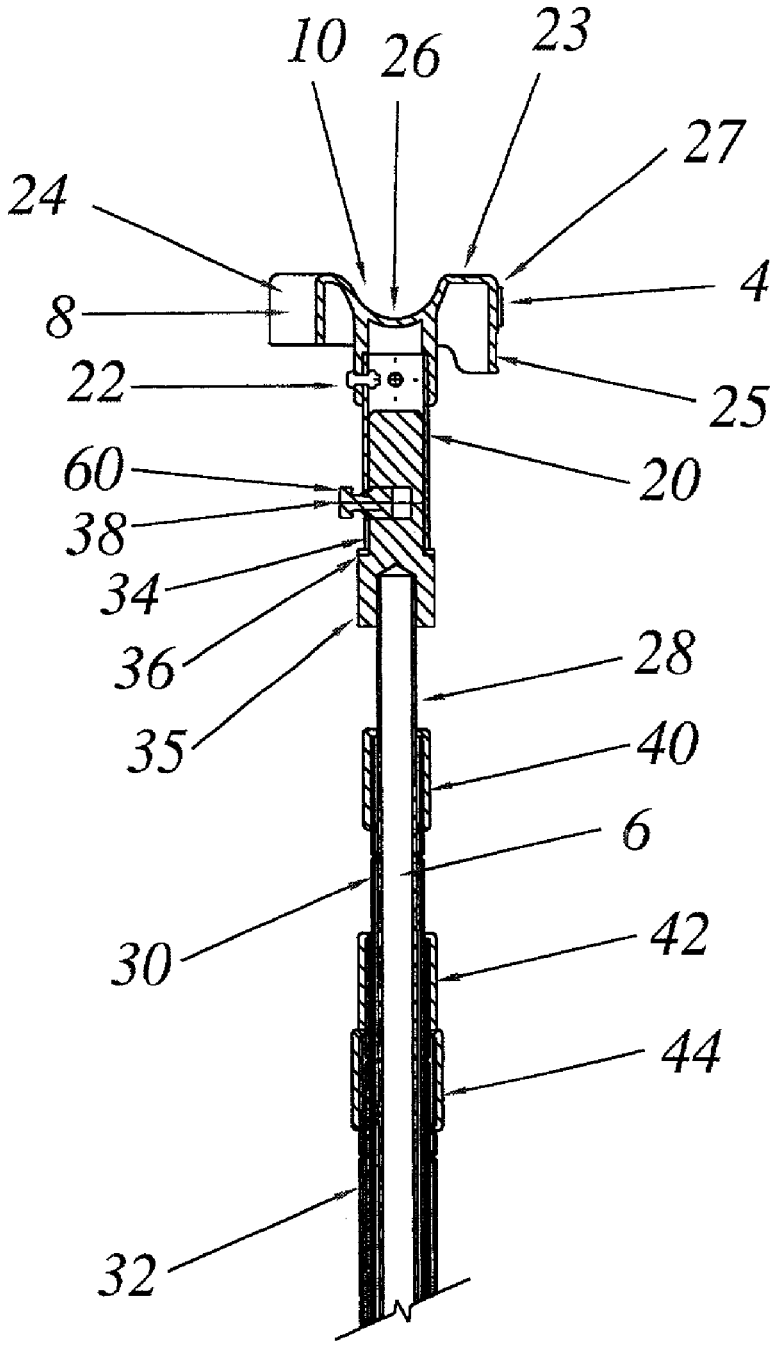
FIG. 3 is a partial enlarged side elevational sectional view of the golf accessory shown in FIG. 1.

The three linear concentric hollow rods of different diameters, referred to above, are shown in FIG. 3, and consist of inner extendible hollow rod 28, which is slidable within intermediate extendible hollow rod 30. Intermediate hollow rod 30, in turn, is slidable within outer extendible hollow rod 32. Extendible hollow rods 28, 30 and 32 are compressible within base tube 33. The top of inner hollow rod 28 includes a head attachment 34 riveted thereon. Head attachment 34 also includes a lower portion 35 having a top surface on which a rubber bumper washer 36 is seated. Head attachment 34 includes a spring loaded push-in lock 38 to secure replaceable head 4 on head attachment 34. When secured in this manner, the bottom of replaceable head 4 is seated on the rubber bumper washer 36. It should also be noted that heads having different functions than those described herein may be mounted on head attachment 34.

Outer extendible hollow rod 32 includes a twist cap 44 which is utilized to twist hollow rod 32 so that a cam on hollow rod 32 moves in and out of functional engagement with the interior of base tube 33. Similarly, intermediate extendible hollow rod 30 includes a twist cap 42 which is utilized to twist hollow rod 30 so that a cam on hollow rod 30 moves in and out of functional engagement with the interior of hollow rod 32. Inner extendible hollow rod 28 also includes a twist cap 40 which is utilized to twist hollow rod 28 so that a cam on hollow rod 28 moves in and out of functional engagement with the interior of hollow rod 30. The cams referred to herein are described below in connection with the discussion of FIGS. 7 through 9.

Figure 4:
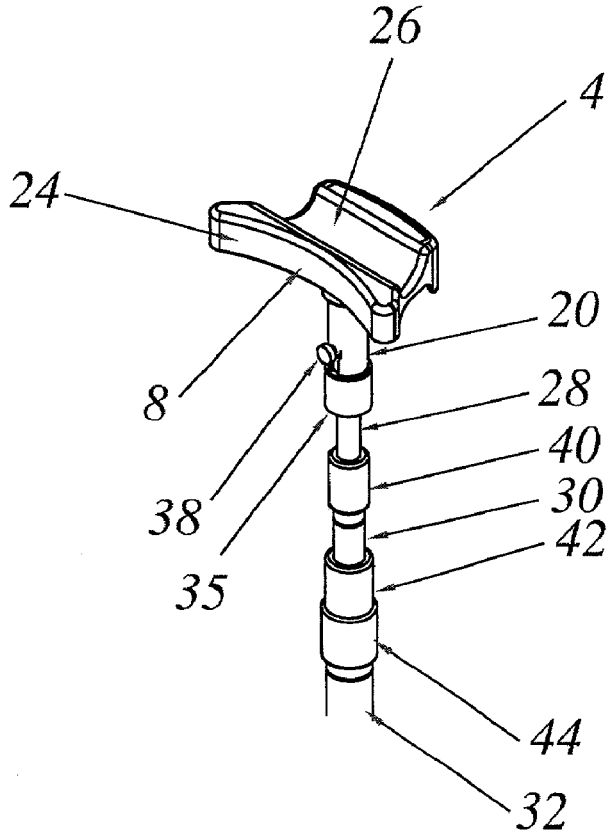
FIG. 4 is a perspective view of the releasably mounted combination cigar holder and golf club rest head shown in FIG. 1.
Figure 5:
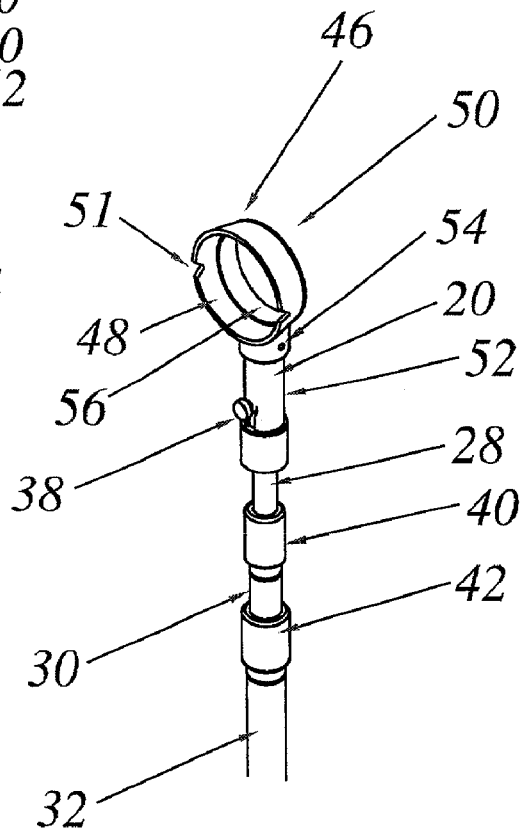
FIG. 5 is a perspective view of a releasably mounted golf ball retriever head which is interchangeable with the combination cigar holder and golf club rest head shown in FIG. 4.
Figure 6A:
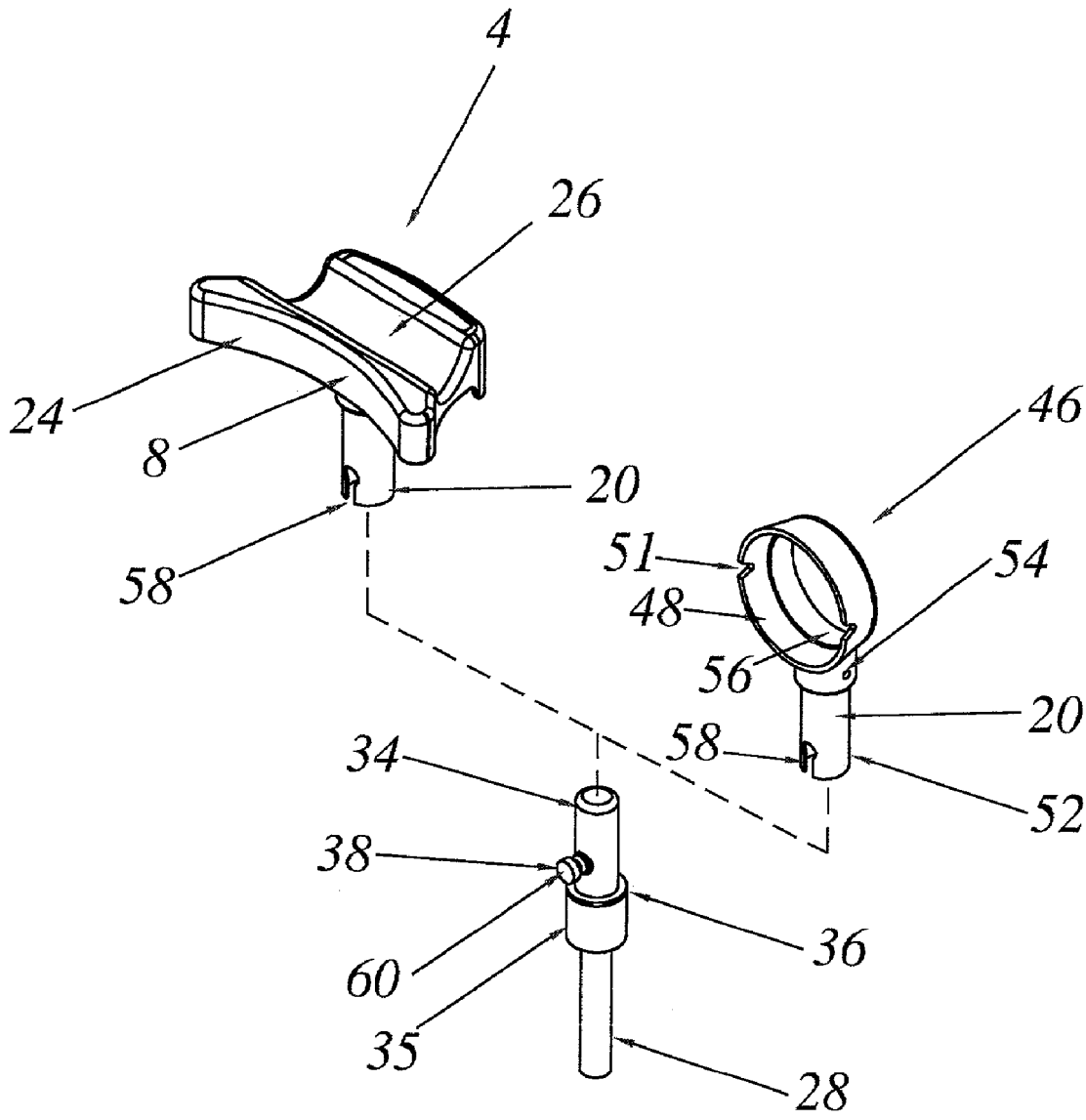
FIG. 6A is a perspective view illustrating the manner in which the combination cigar holder and golf rest head shown in FIG. 4 and the golf ball retriever shown in FIG. 5 is mounted to the body portion of the golf accessory.
Figure 6B:
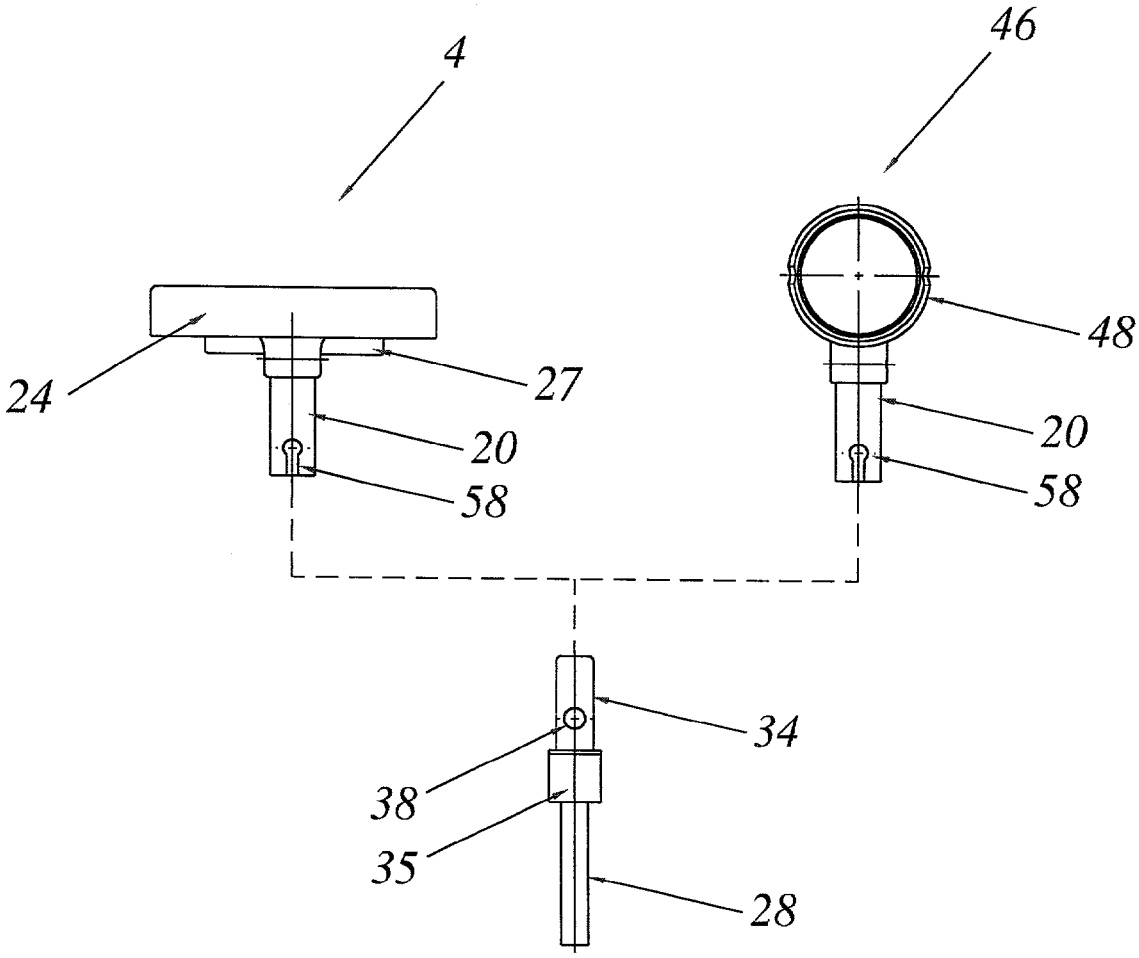
FIG. 6B is a front elevational view illustrating the manner in which the combination cigar holder and golf rest head shown in FIG. 4 and the golf ball retriever shown in FIG. 5 is mounted to the body portion of the golf accessory.
Figure 6C:
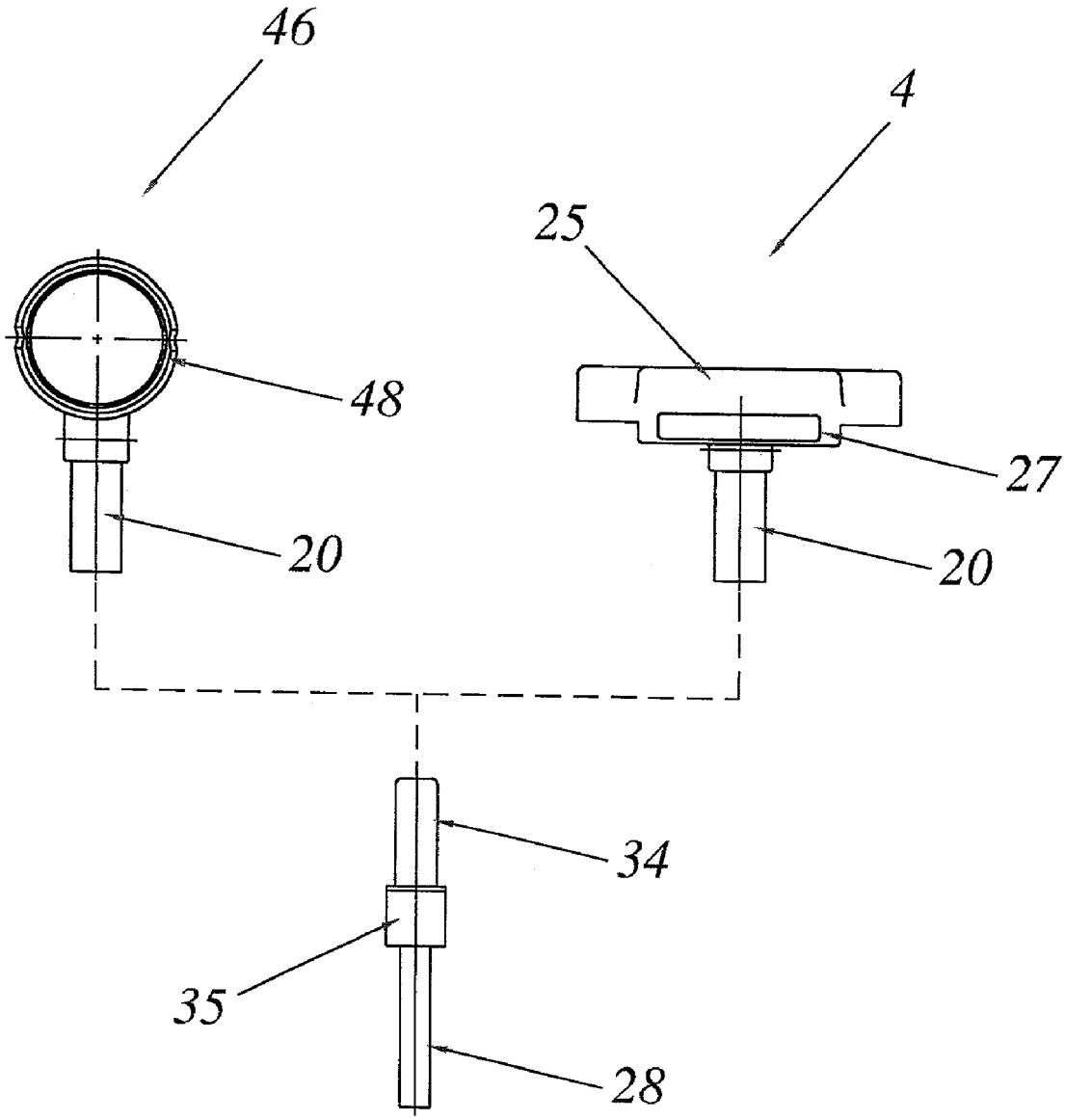
FIG. 6C is a rear elevational view illustrating the manner in which the combination cigar holder and golf rest head shown in FIG. 4 and the golf ball retriever shown in FIG. 5 is mounted to the body portion of the golf accessory.
Figure 6D:
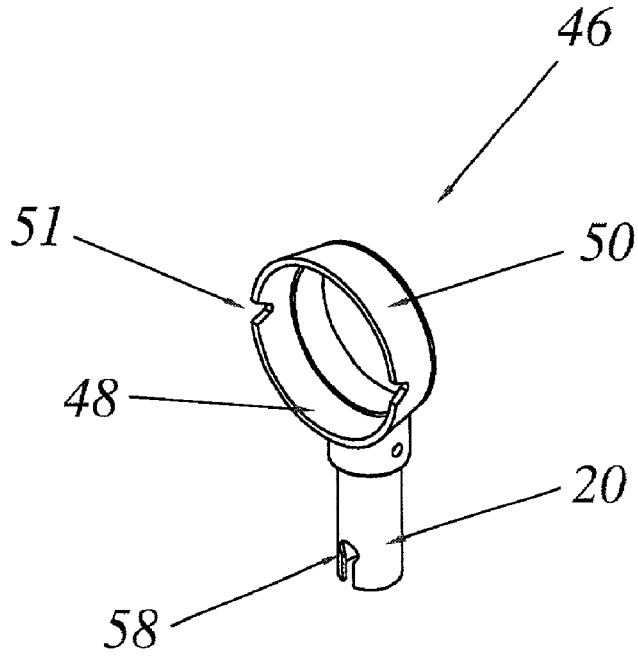
FIG. 6D is a perspective view of the golf ball retriever head.
Figure 6E:
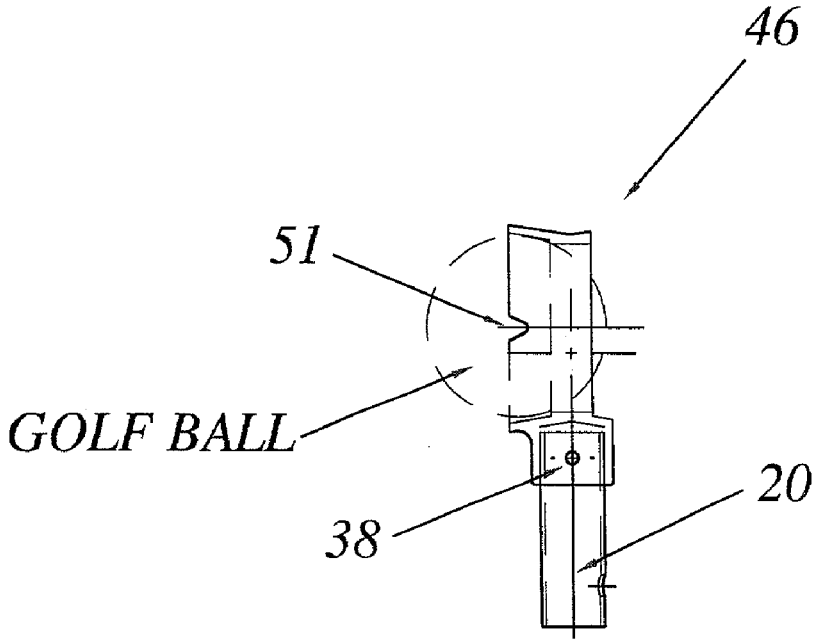
FIG. 6E is a side elevational view of the golf ball retriever head.
Figure 6F:
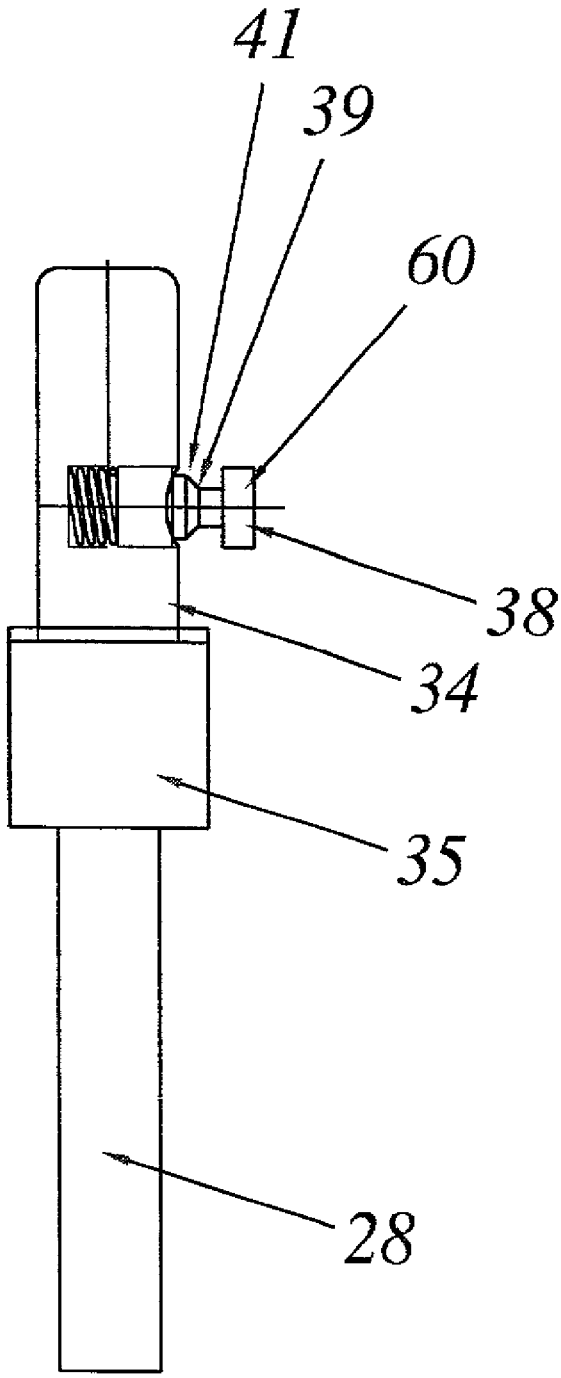
FIG. 6F is a side elevational view of the attachment head of the present invention.

FIG. 4 is an enlarged perspective view of releasably mounted combination cigar holder and golf club rest head 4 and FIG. 5 is an enlarged perspective view of releaseably mounted golf ball retriever head 46. Both replaceable head 4 and replaceable head 46 are connected to body 6 in the same manner.

Replaceable head 46 includes an integral ball retrieving resilient ring 48 which is attached to a cylindrical sleeve 52 by a rivet 54. Ball retrieving ring 48 comprises opening 56 which is of a size so that when retrieving ring 48 is placed under a golf ball submersed in water, the golf ball can be scooped up and retrieved in the opening 56 of ring 48. Ball retrieving ring 48 includes notches 51 which permit the resilient ring 48 to be placed over a golf ball and expand over and grasp the golf ball so that it may be lifted by the ball retriever head 46.

The manner in which head 4 or head 46 are connected with body portion 6 is shown in FIGS. 6*a* to 6*f*. Since both head 4 and head 46 are connected to body portion 6 in the same manner, only the manner in which head 4 is attached to body portion 6 will be described. Head 4 includes a quick connect keyed slot 58 at the bottom of cylindrical sleeve 20. Spring loaded push-in lock 38 on head attachment 34 includes a spring loaded plunger 39 having a raised surface 41 and an external head 60. To connect head 4 on head attachment 34 of body 6, external head 60 is depressed so that the cylindrical sleeve 20 of head 4 may be placed over head attachment 34 and keyed slot 58 of sleeve 20 is extended behind the external head 60 of spring loaded push-in lock 38. In this position, the bottom of cylindrical sleeve 20 is seated on rubber bumper washer 36. The external head 60 of spring loaded push-in lock 38 is then released and the raised surface 41 is biased against the rear surface of sleeve 20 in locking engagement therewith.

In this manner, the head 4 is positioned on head attachment 34 when a cigar is to be supported on cigar holder 10 and/or when a golf club 16 is to be rested in cradle 8. To release head 4 from head attachment 34 of body 6, the external head 60 of spring loaded push-in lock 38 is depressed and head 4 is lifted upwardly from head attachment 34. Golf ball retriever head 46 may be secured to head attachment 34 in the same manner as head 4 was secured to head attachment 34, and may be released from head attachment 34 in the same manner that head 4 was released.

Figure 7:
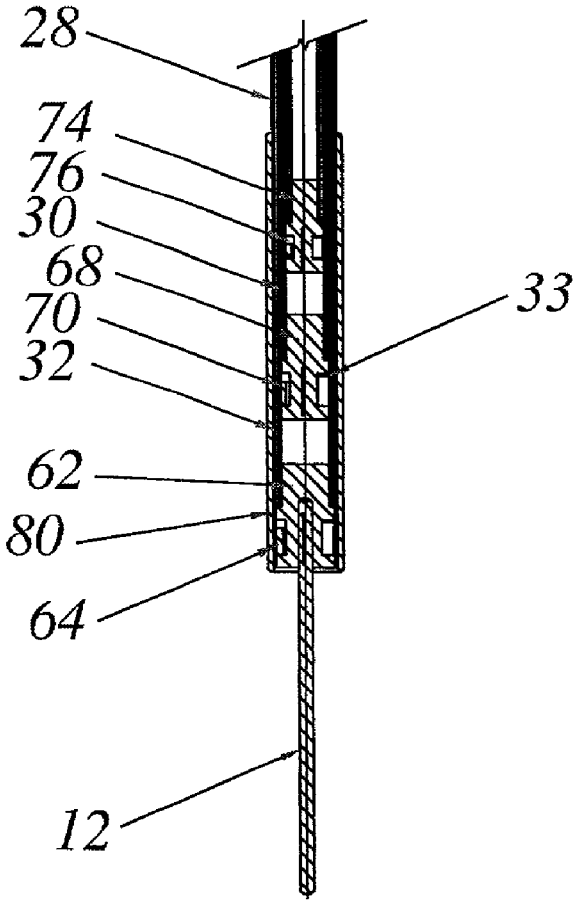
FIG. 7 is a partial enlarged side elevational view, in section, of the golf accessory in its compressed position.

The method and structure by which the hollow rods 28, 30, and 32 are compressed within base tube 33 to form a body portion of length L when the golf accessory 2 is used as a cigar holder and/or golf club rest, and the method and structure by which the three hollow rods 28, 30 and 32 are extended from each other, and from base tube 33, when the golf accessory 2 is used as a golf ball retriever is well known and conventional. As shown in FIG. 7, the inner extendible hollow rod 28, intermediate extendible hollow rod 30 and outer extendible rod 32 are shown in their compressed position within base tube 33. Each rod includes an internal circular ridge (not shown) which serves as a stop to prevent the rod compressed therein from separating therefrom. In this position, stake 12 extends below base tube 33 and may be inserted into the ground when golf accessory 2 functions as a cigar holder and/or golf club rest. The lower portion of outer extendible hollow rod 32 includes a cam holder 62 crimped to hollow rod in which stake 12 is fixed.

Figure 10A:
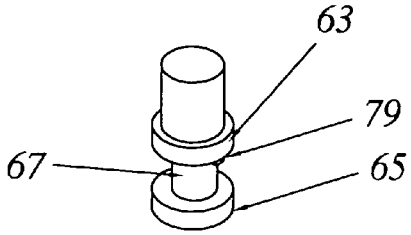
FIG. 10A is a perspective view of the cam holder.

Cam holder 62 comprises circular top portion 63 and circular bottom portion 65 connected by an eccentrically mounted shaft 67 (see FIG. 10A). An offset cam 64, having vertical ribs 77, is formed of spring like reinforced nylon or compatible material. Offset cam 64 surrounds eccentrically mounted shaft 67 and is moveable thereby. Offset cam 64 includes two edges 69 and 71 (see FIG. 10B) which cooperate with a stop 79 on the bottom of top portion 63 of cam holder 62 to limit cam rotation. Offset cam 64 includes relatively thick cam portions 73 and an integral relatively thin section 75 (see FIG. 10C).

Figure 10B:
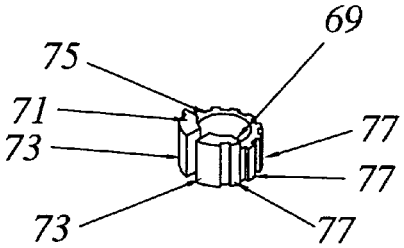
FIG. 10B is a perspective view of the offset cam.
Figure 10C:
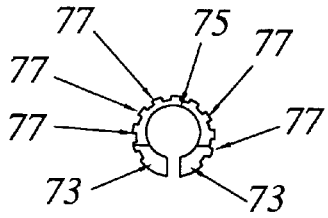
FIG. 10C is a top view of the offset cam.
Figure 10D:
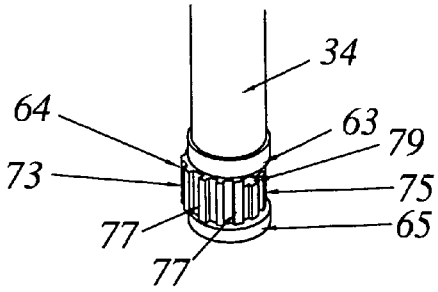
FIG. 10D is a perspective view of the cam holder with the cam in engaged position.
Figure 10E:
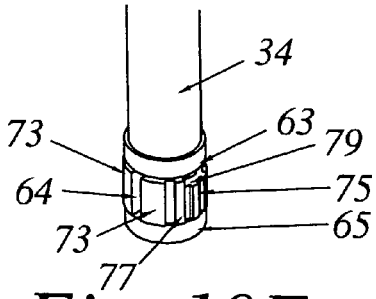
FIG. 10E is a perspective view of the cam holder with the cam in disengaged position.

When twist tube 44 on rod 32 (see FIG. 3) is twisted in a first direction it will rotate eccentrically mounted shaft 67 in the same direction, and offset cam 64, which surrounds shaft 67, will be moved to the position shown in FIG. 10D. In this position arm portions 73 of offset cam 64 extend outwardly from the plane of rod 32 and frictionally engage the inner wall of base tube 33 to maintain rod 32 in engagement with base tube 33. When twist tube 44 is twisted in the opposite direction it will rotate eccentrically mounted shaft 67 in the same direction and offset cam 64 will be moved to the position shown in FIG. 10E. In this position cam 64 is disengaged from the inner wall of rod 33 so that rod 32 is slideable within base tube 33.

The lower portion of intermediate extendible hollow rod 30 includes a cam holder 68 crimped thereto. Cam holder 68 of intermediate rod 30 includes an offset cam 70 at the bottom thereof. When twist tube 42 on rod 30 (see FIG. 3) is twisted in a first direction, it will cause cam 70 to frictionally engage the inner wall of rod 32 to maintain rod 30 in engagement with rod 32. When twist tube 42 is twisted in the opposite direction, it will cause cam 70 to disengage from the inner wall of rod 32 so that rod 30 is slideable within rod 32.

The lower portion of inner extendible hollow rod 28 includes a cam holder 74 crimped thereto. Cam holder 74 of inner rod 28 includes an offset cam 76 at the bottom thereof. When twist tube 40 on rod 28 (see FIG. 3) is twisted in a first direction, it will cause cam 76 to frictionally engage the inner wall of rod 30 to maintain rod 28 in engagement with rod 30. When twist tube 40 is twisted in the opposite direction, it will cause cam 76 to disengage from the inner wall of rod 30 so that rod 28 is slideable within rod 30.

Figure 8:
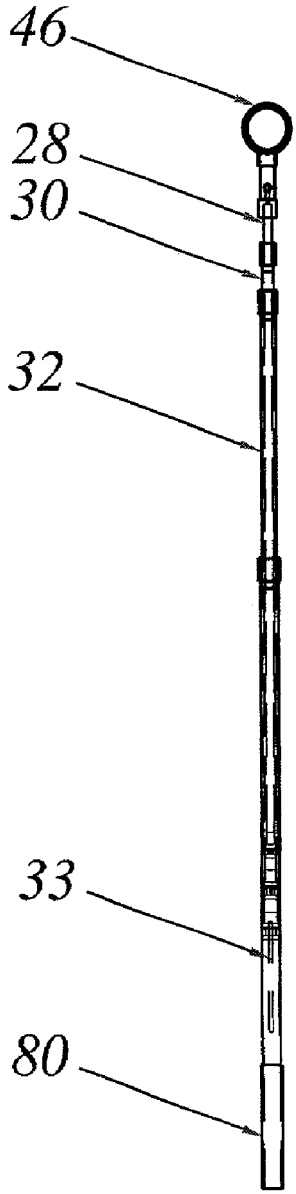
FIG. 8 is a side elevational view of the golf accessory in its partially extended position with the golf ball retriever head mounted on the body portion.

FIG. 8 shows the golf accessory when it is functioning as a golf ball retriever and wherein only outer extendible rod 32 has been extended. Rod 32 has been extended by twisting tube cap 44 in the direction to disengage cam 64 from the inner wall of base tube 33 and then sliding rod 32 from within base tube 33 until the desired length of rod 32 with respect to base tube 33 is achieved. Stake 12 carried by rod 32 should be completely withdrawn into base tube 33 when the golf accessory is functioning as a golf ball retriever. Then tube cap 44 is twisted to frictionally re-engage cam 64 within the inner wall of base tube 33 to again maintain rod 32 in engagement with base tube 33.

Figure 9:
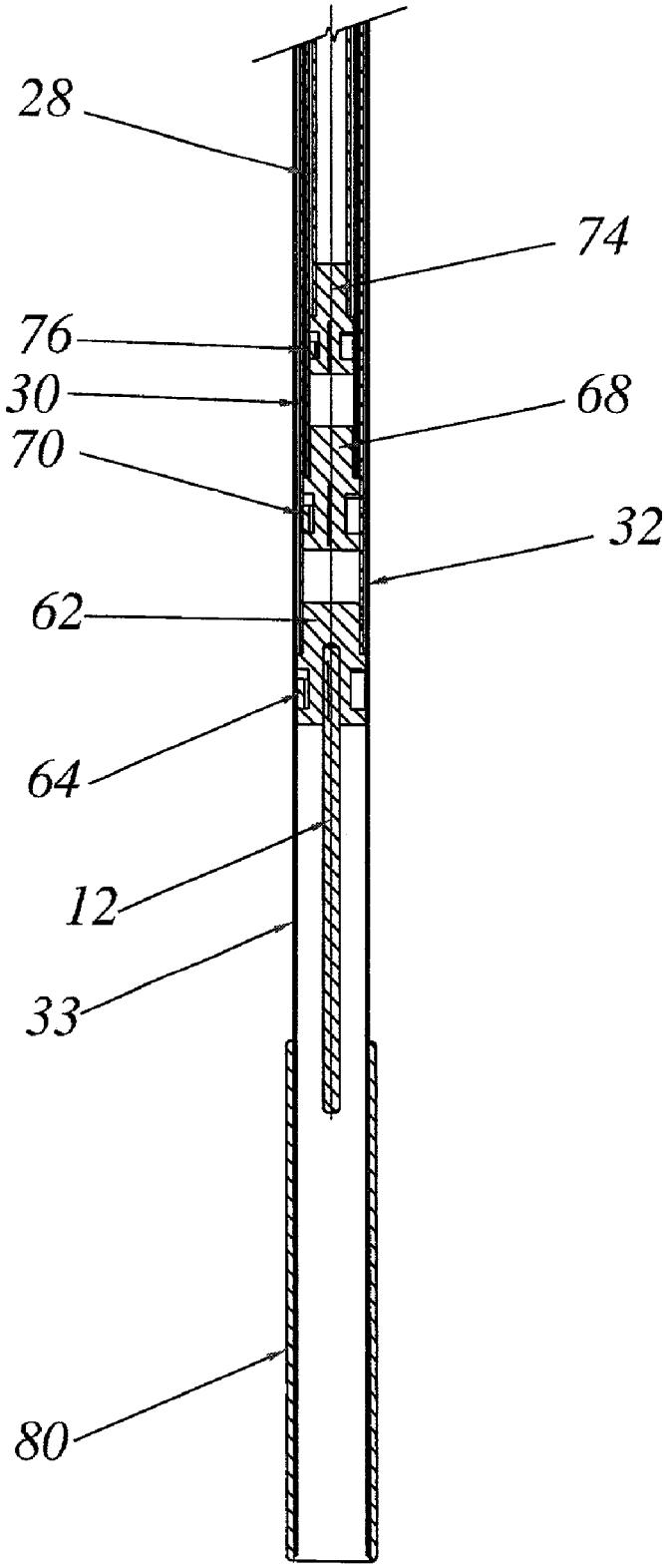
FIG. 9 is a partial enlarged side elevational view, in section, of the golf accessory in its extended position.

While in FIG. 8, intermediate rod 30 and inner rod 28 have not been extended, they may be extended in a similar manner to provide a golf ball retriever of greater length. More specifically, as shown in FIG. 9, rod 30 may be extended (from the position shown in FIG.7) by twisting tube cap 42 in the direction to disengage cam 70 from the inner wall of rod 32 and then sliding rod 30 out from within rod 32 until the desired length of rod 30 with respect to rod 32 is achieved. Then tube cap 42 is twisted to frictionally re-engage cam 70 within the inner wall of rod 32 to again maintain rod 30 in engagement with rod 32. Similarly rod 28 may be extended (from the position shown in FIG. 7) by twisting tube cap 40 in the direction to disengage cam 76 from the inner wall of rod 30 and then sliding rod 28 out from within rod 30 until the desired position of rod 28 with respect to rod 30 is achieved. Then tube cap 40 is twisted to frictionally re-engage cam 76 within the inner wall of rod 30 to again maintain rod 28 in engagement with rod 30.

The cam 64 and cam holder 62, illustrated in FIGS. 10 to 10*b*, are the same as cam 70 and cam holder 68, and as cam 76 and cam holder 74, except that cam holder 62 includes stake 12, and all of these cams operate in the manner described above.

When so extended, and as an example only, golf accessory 2 may be approximately 10 feet in length, and in its compressed position, it may be approximately 30 inches in length. Golf accessory 2 also includes a soft grip rubber handle 80 surrounding the lower portion of base tube 33 which enables the golfer to comfortably use the golf accessory when retrieving golf balls. Handle 80 may be located above the bottom of base tube 33 a sufficient distance so that handle 80 will not come into contact with the ground when the golf accessory is used as a cigar holder and golf club rest and stake 12 is in the ground.

Figure 11:
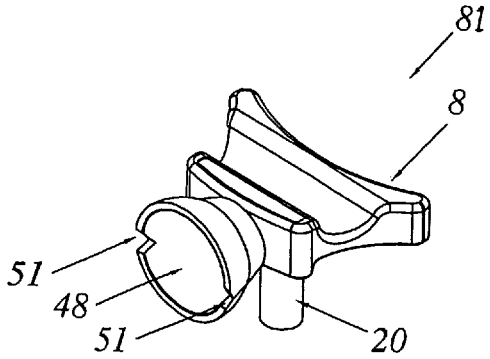
FIG. 11 is a front perspective of a second embodiment of the golf accessory head comprising a cigar holder, golf club rest and golf ball retriever as an integral unit.
Figure 11A:
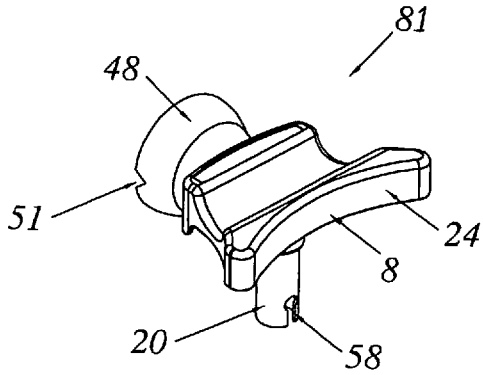
FIG. 11A is a rear perspective of the golf accessory head shown in FIG. 11.
Figure 11B:
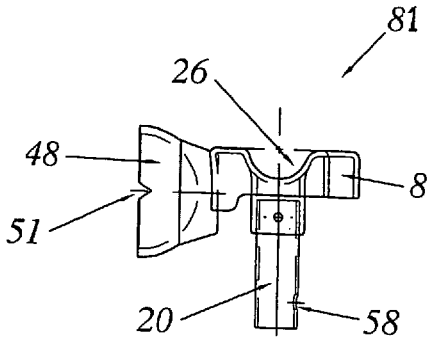
FIG. 11B is a side elevation of the golf accessory head shown in FIG. 11.

The head 81 shown in FIGS. 11 to 11*b* is essentially a result of combining previously described cigar and golf club rest 4 and golf ball retriever head 46. Thus the same reference numerals, when applicable, will be used to describe head 81 as were used to describe heads 4 and 46. Head 81 consists of a cradle 8 which serves as a golf club rest and a cigar holder 10 for holding a cigar. Cradle 8 includes a vertical concave surface 24, best seen in FIG. 11*a* on which the handle or shaft of a golf club rests. Cigar holder 10 includes a concave surface 26, best seen in FIG. 11*b*, on which the cigar may rest. Head 81 includes a golf ball retrieving ring 48 having notches 51 therein. Head 81 also includes a quick connect keyed slot 58 at the bottom of cylindrical sleeve 20. Head 81 is attached to head attachment 34 in the same manner that heads 4 and 46 are attached to head attachment 34.

This invention has been described above with reference to presently preferred embodiments of the invention. The description has not, however, been presented as a catalog exhaustive of all forms which this invention may take. Accordingly, workers skilled in the art to which this invention pertains will readily appreciate that variations, alterations or modifications in the structures, procedures, and arrangements described above may be practiced without departing from the scope of this invention. Thus, the foregoing description should not be read as limiting the scope of this invention to less than the fair scope of the following claims.

What is claimed as novel and desired to be secured by Letters Patents is:

1. A golf accessory, which is interchangeably used as a releasably mounted cigar holder and golf club rest, or, when the cigar holder and club rest are released from the golf accessory, as a golf ball retriever and wherein the cigar holder and golf club rest are releasably mounted on a body portion of the golf accessory and wherein the body portion comprises an outer extendible hollow rod, an intermediate extendible hollow rod and an inner extendible hollow rod and wherein said inner hollow rod is compressible within said intermediate hollow rod and alternatively extendible from said intermediate hollow rod and wherein said intermediate hollow rod is compressible within said outer hollow rod and alternatively extendible from said outer hollow rod and wherein the outer extendible rod includes a stake for insertion into the ground when said outer extendible rod is compressed within a base tube.

2. A golf accessory comprising a cigar holder and golf club rest, in which the cigar holder and golf club rest are releasably mounted on a body portion of the golf accessory and wherein the body portion comprises an outer extendible hollow rod, an intermediate extendible hollow rod and an inner extendible hollow rod and wherein said inner hollow rod is compressible within said intermediate hollow rod and alternatively extendible from said intermediate hollow rod and wherein said intermediate hollow rod is compressible within said outer hollow rod and alternatively extendible from said outer hollow rod and wherein the outer extendible hollow rod includes a stake for insertion into the ground when said outer extendible hollow rod is compressed within a base tube.

3. A golf accessory as in claim 2, wherein the body portion of the golf accessory comprises at least two hollow concentric rods.

4. A golf accessory as in claim 3, wherein one rod is compressible within the other rod and alternatively extendible from the other rod.

5. A golf accessory which is interchangeably used as a releasably mounted cigar holder, or when the cigar holder is released from the golf accessory, as a golf ball retriever and wherein the cigar holder is formed of flame retardant plastic or metal, is arcuately shaped, and is on a head which is releasably mounted on a body portion of the golf accessory, and wherein the golf ball retriever is releasably mounted on a body portion of the golf accessory and comprises at least one golf ball retrieving ring on a head which is releasably mounted on the body portion of the golf accessory and wherein the body portion of the golf accessory comprises an outer hollow rod, an intermediate hollow rod and an inner hollow rod and wherein said inner hollow rod is compressible within said intermediate hollow rod and alternatively extendible from said intermediate hollow rod and wherein said intermediate hollow rod is compressible within said outer hollow rod and alternatively extendible from said outer hollow rod and wherein the outer hollow rod includes a stake for insertion into the ground when said intermediate hollow extendible hollow rod is compressed within a base tube.

6. A golf accessory which is interchangeably used as a releasably mounted golf club rest or, when the golf club is released from the golf accessory, as a golf ball retriever and wherein the golf club rest is arcuately shaped, and wherein the golf club rest is releasably mounted on a body portion of the golf accessory, and wherein the golf club rest is on a head which is releasably mounted on the body portion of the golf accessory, and wherein the golf ball retriever is releasably mounted on a body portion of the golf accessory, and wherein the golf ball retriever comprises at least one ball retrieving ring on a head which is releasably mounted on the body portion of the golf accessory, and wherein the body portion comprises an outer hollow rod and an inner hollow rod and wherein said inner hollow rod is compressible within said intermediate hollow rod and alternatively extendible from said intermediate hollow rod and wherein said intermediate hollow rod is compressible within said outer hollow rod and alternatively extendible from said outer hollow rod, and wherein the outer hollow rod includes a stake for insertion into the ground when said intermediate hollow rod is compressed within a base tube.

7. A golf accessory as in claim 6, wherein the body portion of the golf accessory comprises at least two hollow concentric rods.

8. A golf accessory as in claim 7, wherein one rod is compressible within the other rod and alternatively extendible from the other rod.

9. A golf accessory having heads for performing different functions wherein said heads are interchangeably releasable and mounted on a body portion, and wherein said body portion having means for connecting one of said heads and wherein one of said heads is a cigar holder, and wherein one of said heads is a club rest, and wherein the body portion comprises an outer extendible hollow rod, an intermediate extendible hollow rod and an inner extendible hollow rod and wherein said inner hollow rod is compressible within said intermediate hollow rod and alternatively extendible from said intermediate hollow rod and wherein said intermediate hollow rod is compressible within said outer hollow rod and alternatively extendible from said outer hollow rod, and wherein, the outer extendible hollow rod includes a stake for insertion into the ground when said outer extendible hollow rod is compressed within a base tube.

10. A golf accessory having heads for performing different functions wherein said heads are interchangeably releasable and mounted on a body portion, and wherein said body portion having means for connecting one of said heads and wherein one of said heads is a cigar holder and wherein the body portion has a stake thereon which extends therefrom when the golf accessory, in use, is to be maintained in the ground and which retracts into the body portion when the golf accessory, in use, is to be held by hand.

* * * * *